US006215376B1

(12) United States Patent
Hagström et al.

(10) Patent No.: US 6,215,376 B1
(45) Date of Patent: Apr. 10, 2001

(54) FILTER CONSTRUCTION AND OSCILLATOR FOR FREQUENCIES OF SEVERAL GIGAHERTZ

(75) Inventors: Panu Hagström, Oulu; Jari Pelkonen, Tuomioja, both of (FI)

(73) Assignee: LK-Products Oy, Kempele (FI)

( * ) Notice: Subject to any disclaimer, the term of this patent is extended or adjusted under 35 U.S.C. 154(b) by 0 days.

(21) Appl. No.: 09/310,706

(22) Filed: May 7, 1999

(30) Foreign Application Priority Data

May 8, 1998 (FI) ..... 981026

(51) Int. Cl.[7] ..... H01P 1/20; H01P 7/04

(52) U.S. Cl. ..... 333/203; 333/206; 333/223

(58) Field of Search ..... 333/202, 203, 333/206, 207, 222, 223, 224, 225, 226

(56) References Cited

U.S. PATENT DOCUMENTS

| | | | | |
|---|---|---|---|---|
| 3,617,954 | | 11/1971 | Levy et al. . | |
| 4,066,988 | * | 1/1978 | Karp | 333/202 |
| 4,342,969 | | 8/1982 | Myers et al. . | |
| 4,410,868 | * | 10/1983 | Meguro et al. | 333/202 |
| 5,130,683 | | 7/1992 | Agahi-Kesheh et al. . | |
| 5,262,742 | | 11/1993 | Bentivenga . | |
| 5,525,946 | | 6/1996 | Tsujiguchi et al. . | |
| 5,557,246 | | 9/1996 | Ishihara et al. . | |
| 5,557,247 | * | 9/1996 | Vaughn, Jr. | 333/219 |
| 5,684,439 | | 11/1997 | Vangala . | |
| 5,923,233 | * | 7/1999 | Jantunen et al. | 333/235 |
| 6,023,207 | * | 2/2000 | Ito et al. | 333/206 |

FOREIGN PATENT DOCUMENTS

| | | | |
|---|---|---|---|
| 2653856 | 2/1978 | (DE) | H01P/1/20 |
| 685898 | 6/1995 | (EP) | H01P/1/205 |
| 98870 | 8/1997 | (FI) . | |
| 1358980 | 3/1974 | (GB) | H01P/1/20 |

* cited by examiner

*Primary Examiner*—Benny Lee
*Assistant Examiner*—Patricia T. Nguyen
(74) *Attorney, Agent, or Firm*—Darby & Darby

(57) ABSTRACT

A radio-frequency filter (400, 500, 600) comprises a base plate (401, 603) and an electrically conductive ground plane in connection with it, a predetermined number of inner conductors (403A–403G, 501, 502, 601) attached substantially perpendicularly to the base plate which have a first end and second end, and an electrically conductive casing (402, 503, 602) which is connected at one side to the base plate and substantially surrounds said inner conductors.

A first end of each inner conductor is in contact with said ground plane and a second end is in contact with said electrically conductive casing so that the resonators comprising the inner conductors, ground plane and casing function as half-wave resonators.

8 Claims, 3 Drawing Sheets

FILTER CONSTRUCTION AND OSCILLATOR FOR FREQUENCIES OF SEVERAL GIGAHERTZ

TECHNOLOGICAL FIELD

The invention relates in general to constructions of radio-frequency filters and oscillators. In particular the invention relates to a filter and oscillator construction which can be used in the frequency area of several gigahertz.

BACKGROUND OF THE INVENTION

FIG. 1 shows a longitudinal section of a known filter construction 100 used particularly in mobile phones in the 450-MHz frequency area. The construction comprises a low-loss printed circuit board 101 onto which finger-like projections 102 have been formed. Around each finger-like projection a cylindrical coil conductor, or helix, 103 has been wound to function as a resonator the electrical length of which is one quarter of the wavelength at the operating frequency. The lower ends, with respect to the position shown, of the helixes are grounded and the upper ends are open. The construction also includes a housing 104 that comprises outer walls and partition walls. Each helix is located inside a compartment of its own, separated from the next compartment by a partition wall. Partition walls may have holes of different sizes in various locations to realize electromagnetic coupling between adjacent helixes. In addition, inter-helix couplings can be realized through strip conductors 105 on the surface of the printed circuit board 101.

FIG. 2 shows a longitudinal section of a known ceramic filter construction 200 used especially in mobile phones in the 900-MHz frequency area. The filter construction is based on a block 201 made of a dielectric ceramic material such that the outer surface of the block is for the greater part plated with an electrically conductive coating 202 and has got holes 203 in it that wholly or partly extend through the ceramic block. Also the inner surfaces of the holes 203 are plated using an electrically conductive material. The inner coating of a hole is at one end in galvanic contact with the coating on the outer walls of the block so that the coating of the hole constitutes a $\lambda/4$ resonator in the same manner as the helix wire in the helix resonator described above. Coupling to the filter is realized through coupling strips 204 formed on the uncoated areas of the block 201. Electromagnetic coupling between resonators is realized through the ceramic material and it can be controlled by varying the amount and pattern of the coating on the block.

FIG. 3 shows a coaxial resonator construction 300 for frequencies above 2 GHz, known from the Finnish patent application FI-970525. For illustrative purposes, part of the electrically conductive casing 301 around the filter is cut out in the drawing. Partition walls 302 divide the casing into compartments in the same manner as in helix resonators. There is one coaxial resonator 303 in each compartment of the filter. FIG. 3 does not show the resonator in the middle compartment of the filter. In the lower parts of the partition walls 302 there are holes to realize electromagnetic couplings. The base plate 304 of the filter is a printed circuit board wherein electrically conductive areas of desired shape and size can be formed on both surfaces and all sides. On the top surface of the base plate there are conductive patterns 305 through which coupling to the resonators 303 is realized and which mediate in the electromagnetic coupling between resonators. On the bottom surface of the base plate there is a substantially continuous electrically conductive coating (not shown) that constitutes a ground plane and is in connection with the metal plating 306 on the edges of the base plate. There are gaps 307 in said metal plating that separate the continuous plating from ports strips 308 and 309. Port strips are narrow conductive areas at the edge of the printed circuit board that have connections to certain conductive patterns on the top surface of the printed circuit board and thereby to certain resonators. At each port strip there is a gap (not shown) in the electrically conductive coating on the bottom surface of the printed circuit board and on the side of the casing to prevent a short circuit between a port strip and the ground plane.

For the attachment of resonators 303 the printed circuit board 304 according to FIG. 3 has at each resonator a hole such that on the inner surface of the hole there is a metal plating or other electrically conductive coating connected to the electrically conductive coating, or ground plane, on the bottom surface of the printed circuit board. The inner surface of the hole need not be metal plated if electric coupling to the resonator can be made reliable enough in some other way. To ensure the best possible electric contact and to realize accurate electromagnetic dimensioning each hole may be encircled by a ring of conductive coating also on the top surface of the printed circuit board. The resonators can be soldered to their places or attached using electrically conductive glue, for example. In the filter according to FIG. 3 there is at the upper end of each resonator a bulge the function of which is to produce a so-called impedance step, i.e. impedance change point in the direction of the longitudinal axis of the resonator. The resonators may also be manufactured without said bulge.

The prior-art filter constructions described above have the problem that they are only applicable to frequencies ranging from a few hundred megahertz to a few gigahertz at the most. In communications systems utilizing new radio technology, such as the wireless local loop (WLL) and wireless local area network (WLAN), there is a visible tendency towards 10 to 20-GHz frequencies which, when realized, would render quarter-wave resonator constructions so small that their mass manufacture with sufficiently precise mechanical tolerances would be impossible, at least at a reasonable cost level.

For frequencies of tens of gigahertz and for optical frequencies filters have been manufactured using waveguides which usually are structures with a rectangular cross section wherein a dielectric core is surrounded by a coating which is reflective at the operating frequency. On both sides of a waveguide in the middle waveguides can be placed that have gaps at regular intervals in their coatings. With suitable location and dimensions of the gaps the waveguides will be coupled only at precisely predetermined frequencies so that the construction can be used as a filter. The manufacturing costs of such a construction are relatively high and repeatability in mass production is poor. In addition, the construction is rather big in size.

SUMMARY OF THE INVENTION

An object of the invention is to provide a filter construction applicable in frequencies of up to about 20 GHz. A particular object of the invention is that the filter construction according to the invention is suitable for large-scale series production such that the unit costs are reasonable and repeatability is good. Another object of the invention is that the mechanical strength of the filter construction is good and temperature compensation can be realized in the filter. A further object of the invention is to provide an oscillator construction applicable in frequencies of up to about 20 GHz.

The objects of the invention are achieved by a filter construction having a plurality of adjacent coaxial resonators the dimensions of which are based on half of the wavelength at the operating frequency. As regards oscillators, the objects of the invention are achieved by a construction having a coaxial resonator the dimensions of which are based on half of the wavelength at the operating frequency, The filter construction according to the invention is characterized in that a first end of each inner conductor is connected to the ground plane and a second end is connected to an electrically conductive casing so that the resonators comprised of the inner conductors, ground plane and casing function as half-wave resonators.

The oscillator construction according to the invention is characterized in that a first end of the inner conductor is connected to the ground plane and a second end is connected to an electrically conductive casing so that the resonator comprised of the inner conductor, ground plane and casing functions as a half-wave resonator.

The electrical length of a half-wave resonator is twice that of a quarter-wave resonator. At frequencies of several gigahertz this can be utilized by having half-wave resonators as filter resonators or a half-wave resonator as the oscillator resonator. In a preferred embodiment of the invention the resonator comprised of a straight inner conductor and conductive outer shell separated by a gaseous medium, preferably air. The outer shell may be simply formed of a base plate and casing. The inner conductors are attached at a first end to the base plate and at a second end to the casing. The inner conductors may have even thick ness or their cross section may vary in the longitudinal direction of the inner conductor in various ways. The casing comprises partition walls to separate adjacent inner conductors from each other. The partition walls may have holes in them to realize electromagnetic couplings between resonators.

Temperature compensation in a resonator refers to the compensation for a change in the electrical characteristics of the resonator caused by a change in the temperature. In accordance with the invention the inner conductor and outer shell of the coaxial resonator can be manufactured using materials having different temperature coefficients of expansion so that thermal expansion in said materials is different. Consequently, the proportions of the construction vary as a function of temperature, which can be utilized in temperature compensation.

BRIEF DESCRIPTION OF THE DRAWINGS

The invention will now be described in more detail with reference to the preferred embodiments presented by way of example and to the accompanying drawing wherein.

Above in conjunction with the description of the prior art reference was made to FIGS. 1 to 3, so below in the description of the invention and its preferred embodments reference will be made mainly to FIGS. 4 to 6. Like elements in the drawing are denoted by like reference designators.

DETAILED DESCRIPTION OF THE INVENTION

Figure 4:
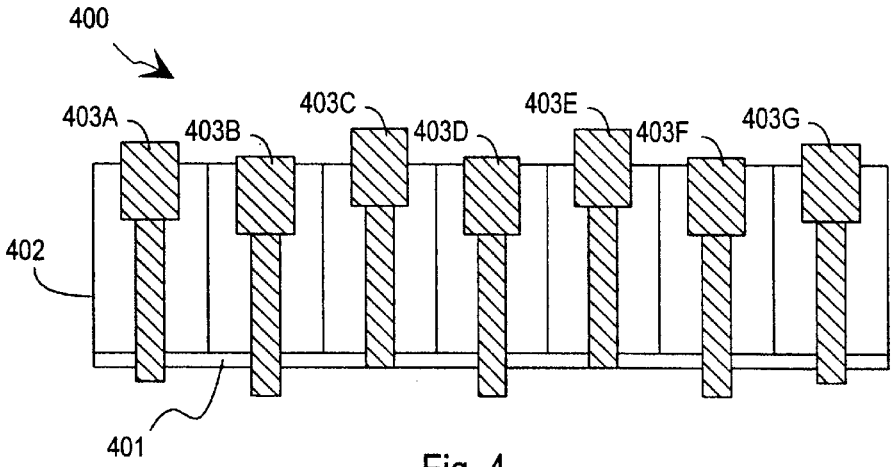
FIG. 4 shows a filter construction according to the invention.

FIG. 4 shows a longitudinal section of a filter 400 including a base plate 401, casing 402 and inner conductors 403A to 403G. The inner conductors 403A to 403G are customarily called resonators, even though a resonator as an electrical structure comprises an inner and outer conductor. The casing 402 corresponds to that of prior-art helix and coaxial filters in that it is basically shaped like a rectangular prism open at one side and additionally comprises partition walls. The outer walls of the casing and the partition walls form a compartment for each resonator.

The base plate 401 is connected to the casing 402 such that it closes the open side of the casing. The base plate may be made of a printed circuit board so that at least one of its surfaces is electrically conductive or, if it is a multilayer circuit board, it has at least one electrically conductive layer. The electrically conductive layer in the base plate is called the ground plane. In a base plate made of a printed circuit board the ground plane is preferably located on the outer surface of the circuit board, i.e. on the bottom surface of the board with respect to the position shown in FIG. 4. The base plate in whole may also be made of metal or other electrically conductive material so that it constitutes a ground plane as such.

Figure 1:
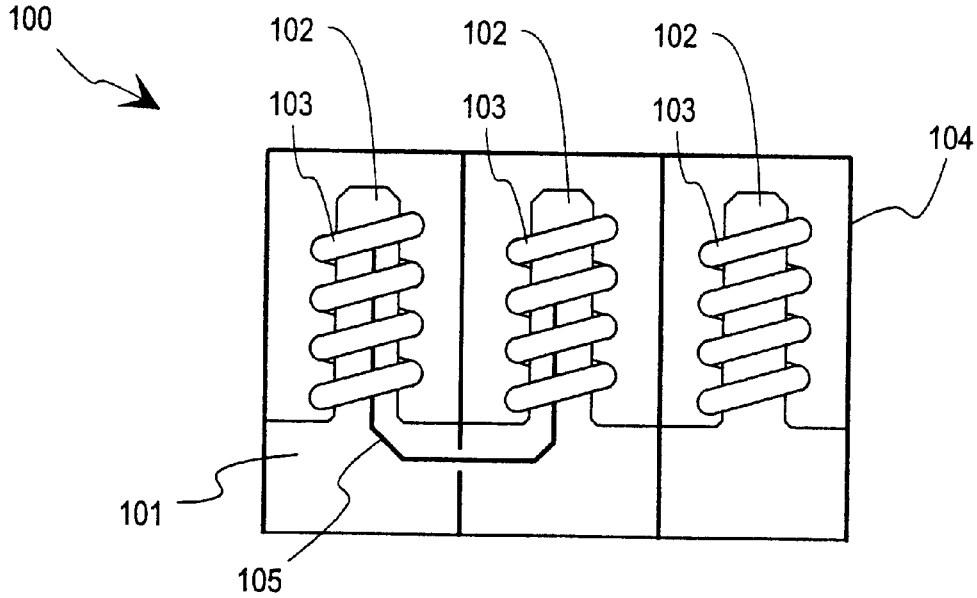
Fig. 1 PRIOR ART
FIG. 1 shows a known filter construction.
Figure 2:
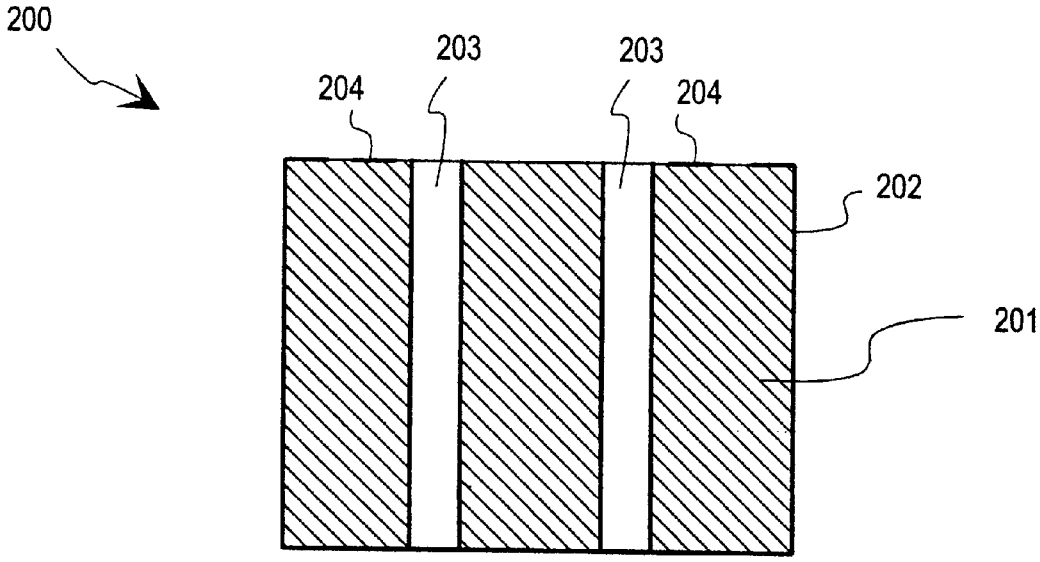
Fig. 2 PRIOR ART
FIG. 2 shows a second known filter construction.
Figure 3:
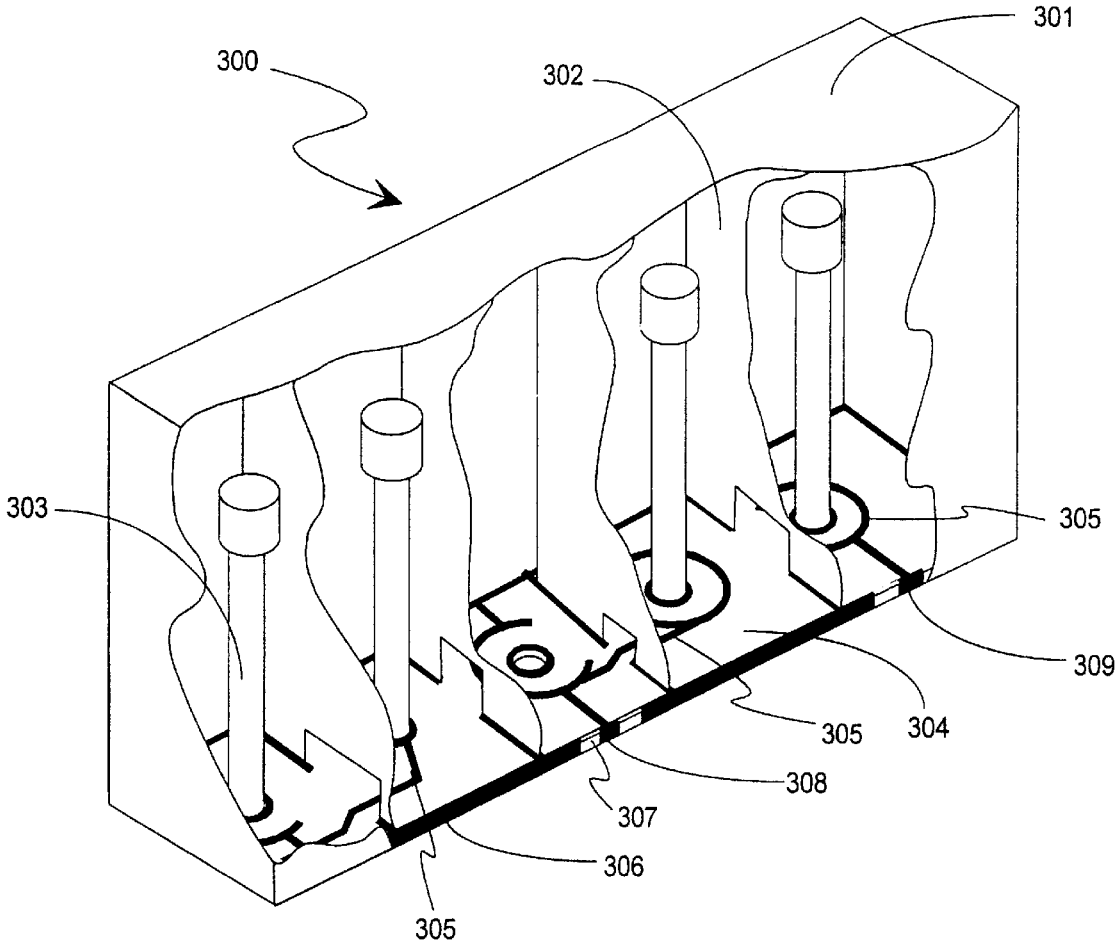
Fig. 3 PRIOR ART
FIG. 3 shows a third known filter construction.

Resonators 403A to 403G are attached to the base plate 401 such that their first end (the bottom end in FIG. 4) is in galvanic contact with the ground plane. A preferred method of attachment was disclosed above in conjunction with the description of the prior art, referring to FIG. 3. If the base plate in whole is metallic, the resonators can be attached to its surface or to holes on its surface by soldering. In addition, the resonators are attached at the other end (the top end in FIG. 4) to the casing preferably such that the casing surface which in FIG. 4 is the top surface has a hole for each resonator and the resonators are connected to the holes by soldering or using electrically conductive glue. If the resonators are not to extend through the upper surface of the casing, no holes are made in the casing but the resonators are attached to the inner surface of the casing. Examining the operation of the construction electrically, we can see that only that portion of elements 403A to 403G which is left between the casing and the ground plane in the base plate functions as an inner conductor.

FIG. 4 shows that each resonator has a bulge, i.e. a point where the area of the cross section of the resonator suddenly increases. This is not necessary as regards the invention, but at least one resonator may be evenly thick or the area of its cross section may change in a continuous manner. Also, all resonators may be evenly thick or the areas of their cross sections may change in a continuous manner. However, it is advantageous from the manufacturing standpoint if all resonators can be made from an identical mechanical piece. In addition, FIG. 4 shows that the resonators are longer than the shortest distance between the base plate and the surface of the casing that is parallel to the base plate and that they are located at different heights with respect to the base plate such that no two adjacent resonators are at the same height with respect to the base plate. This, too, is not necessary as regards the invention, but some of the resonators or all resonators may be as long as the shortest distance between the base plate and the surface of the casing that is parallel to the base plate and/or at least two adjacent resonators may be at the same height with respect to the base plate.

Since in the construction depicted in FIG. 4 the inner conductors of the resonators are at their both ends in galvanic contact with the outer conductor, the resonators are half-wave resonators. The lowest resonating frequency of such a resonator is one that corresponds to a wavelength that equals twice the electrical length of the resonator. The electric field maximum of an evenly thick half-wave resonator is at the middle of the resonator's longitudinal axis, and the magnetic field has maximums at both ends of the resonator. The locations of the maximums of the electric and magnetic fields can be varied by varying the location of the bulge with respect to the resonator ends. In a resonator where the bulge is not located at either end but somewhere in between, the electric field maximum coincides with the bulge.

In order to create input and output ports for the filter as well as certain inter-resonator couplings, it is necessary that coupling elements of desired shape can be formed in the vicinity of the resonators. A possible way to create coupling elements in a filter according to the invention wherein the base plate is a circuit board is one that was discussed above in the description of the prior art, referring to FIG. 3. In that method, conductive patterns are formed on the top surface of the base plate, while the bottom surface of the base plate has a substantially continuous electrically conductive coating which constitutes a ground plane and is in contact with the metal plating on the edges of the base plate which may have gaps for the port strips. "Top surface", "bottom surface" and other directional terms used in this patent application do not limit the invention but refer to filter positions shown in the drawing.

Figure 5:
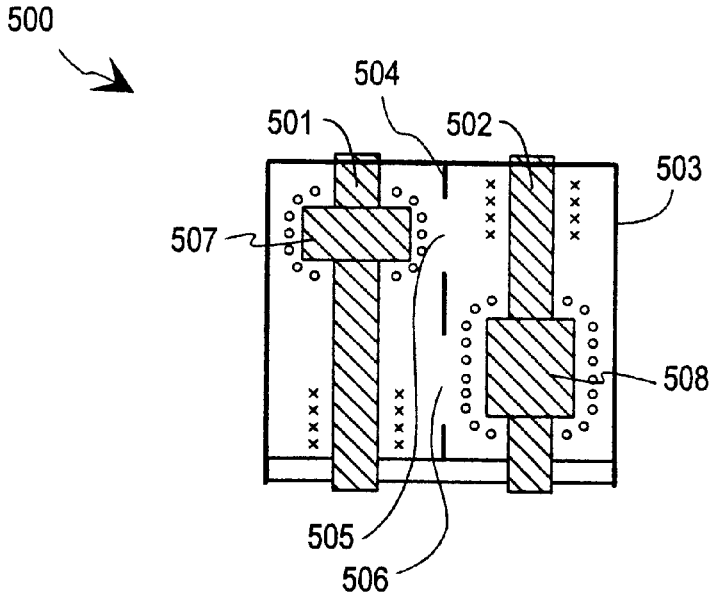
FIG. 5 shows arrangements to realize electromagnetic coupling between resonators.

FIG. 5 shows a longitudinal section of a filter construction 500 according to the invention with only two resonators 501 and 502. The figure particularly illustrates how inter-resonator electromagnetic coupling is arranged using so-called window coupling. A casing 503 which surrounds a filter from above and all sides has a partition wall 504 that divides it into two compartments. The partition wall has an upper window 505 and lower window 506 which are simply holes in the partition wall; the invention does not limit the shape, size or the location of the holes in the partition wall, but rectangular holes are the simplest to calculate and manufacture. A first resonator 501 has a bulge 507 located near the upper end of the resonator, and a second resonator 502 has a bulge 508 located near the lower end of the resonator. The electric field maximum coincides in both resonators with the bulge and is marked by o's. The magnetic field maximum is in both resonators near that end which is farther away from the bulge. The magnetic field maximum is marked by x's.

The upper window 505 coincides with the first resonator's 501 electric field maximum and the second resonator's 502 magnetic field maximum so that the upper window provides electromagnetic coupling between the first resonator's electric field and the second resonator's magnetic field. Correspondingly, the lower window 506 provides electromagnetic coupling between the first resonator's magnetic field and the second resonator's electric field. A coupling between an electric field and magnetic field is usually used to create a zero at a desired location in the filter's frequency response, normally below or above the pass band of a bandpass filter. The filter construction dimensions needed to create the desired zero can be found by experimenting. Zeros can also be created using so-called cross couplings, realized by microstrips and known in the prior art.

Figure 6:
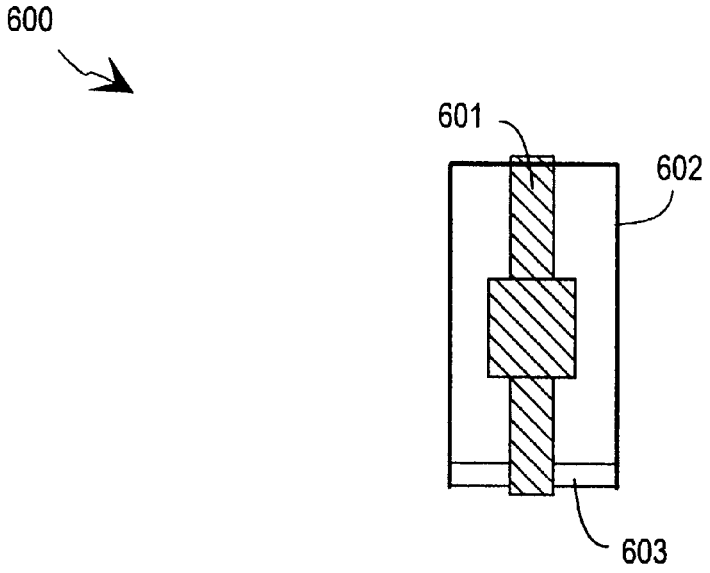
FIG. 6 shows resonator temperature compensation according to the invention.

FIG. 6 shows a resonator 600 according to the invention wherein an inner conductor 601 is enveloped by a casing 602. This can be a multiresonator filter viewed from such a direction that only one resonator can be seen, or an oscillator construction that needs only one resonator. The lower end of the inner conductor is attached to a base plate 603 which also closes the open side of the casing. It is known that when the temperature of the metal or other material used in the inner conductors of a resonator increases, its self-resonant frequency increases as well, which has an effect of shifting the resonant frequency of the whole resonator upwards on the frequency axis. On the other hand, the resonant frequency of a resonator according to FIG. 6 is also affected by the distance between the inner conductor and casing in such a manner that the shorter the distance the higher the resonant frequency. The materials of the inner conductor and casing can be selected such that the material of the inner conductor has a lower temperature coefficient of expansion than the material of the casing, so that when the temperature goes up the casing expands more than the inner conductor. The resulting increase in the distance between the inner conductor and casing has an effect of decreasing the resonant frequency. With suitable dimensions and materials for the inner conductor and casing, the effects of the increase of self-resonant frequency and increase of the distance between the inner conductor and casing cancel each other out, so that the resonant frequency remains nearly the same in spite of the temperature increase. A suitable material for the casing could be e.g. aluminium and a suitable resonator material in that case iron. Temperature compensation is also affected by the location and proportions of a possible bulge in the inner conductor. Suitable dimensions can be determined by experimenting.

The location of the bulge in the resonator's inner conductor shown in FIG.6 is exemplary only. The bulge may be located at another point in the resonator. The resonator may also be evenly thick or its thickness may change steplessly.

Using the construction according to the invention one can relatively easily produce filters and oscillators for a frequency range extending from about 2 GHz to nearly 20 GHz. As it uses half-wave resonators the construction will not be too small, thus avoiding problems related to manufacturability. On the other hand, the construction is much smaller than a waveguide construction with corresponding characteristics. The construction is very sturdy as the inner conductors of the resonators are supported at both ends. The construction has few separate parts and the parts are dimensioned so as to have few factors that would potentially cause variation in the characteristics of the products manufactured.

The embodiments described above are naturally exemplary only and do not limit the invention. In particular, the invention does not limit the number of resonators in a filter. A minimum number required to build a working filter is usually two resonators. The more resonators in a filter, the more accurately one can define the frequency response of the filter. At the same time, however, the physical size of the filter increases and losses become greater An oscillator can be realized using one resonator.

What is claimed is:

1. A radio-frequency resonator filter comprising:

a base plate and an electrically conductive ground plane in connection with it, at least first and second inner conductors attached substantially perpendicularly to the base plate and each having a first end and a second end, and an electrically conductive casing which is connected to the base plate and substantially surrounds said inner conductors, wherein the first end of each inner conductor is in contact with said ground plane and the second end of each inner conductor is in contact with said electrically conductive casing, and wherein said casing comprises a partition wall between said at least first and second inner conductors, said partition wall having at least one hole to provide for an electromagnetic coupling.

2. The radio-frequency resonator filter of claim 1, wherein at least a first inner conductor and a second inner conductor each comprise a bulge to create an impedance step.

3. The radio-frequency resonator filter of claim 2, wherein the bulge in said first inner conductor is at an essentially a different distance from the base plate of the radio-frequency filter than the bulge in said second inner conductor.

4. The radio-frequency resonator filter of claim 3, wherein said hole of the partition wall is at a point that corresponds to a magnetic field maximum in said first inner conductor and to an electric field maximum in said second inner conductor.

5. The radio-frequency resonator filter of claim 1, wherein said base plate is a printed circuit board including on its first surface a ground plane and on its second surface electrically conductive patterns to provide couplings between resonators of said resonator filter.

6. The radio-frequency resonator filter of claim 1, wherein said casing is of a different material than said inner conductors, and the coefficient of thermal expansion of the material of said casing is greater than the coefficient of thermal expansion of the material of said inner conductors in order to realize temperature compensation in the frequency response of the radio-frequency filter.

7. The radio-frequency resonator filter of claim 1, wherein the operating band of said radio-frequency resonator filter is located in the frequency range of 2 GHz to 20 GHz.

8. A radio-frequency oscillator comprising:

a base plate and an electrically conductive ground plane in connection with it, an inner conductor which is attached substantially perpendicularly to the base plate and has a first end and a second end, and an electrically conductive casing which is connected to the base plate and substantially surrounds said inner conductor, wherein the length of said inner conductor is between 0.75 and 7.5 cm, the first end of the inner conductor is in contact with said ground plane and the second end is in contact with said electrically conductive casing.

* * * * *